US005775246A

United States Patent [19]

Lin

[11] Patent Number: 5,775,246

[45] Date of Patent: Jul. 7, 1998

[54] UNDER TRIMMING DEVICE WITH INCLINEDLY MOVABLE CATCHERS FOR A MULTI-NEEDLE SEWING MACHINE WITH MULTIPLE LONGITUDINALLY EXTENDING LOOPERS

[75] Inventor: Yu Wen Lin, Taipei, Taiwan

[73] Assignee: Kaulin Mfg. Co., Ltd., Taipei, Taiwan

[21] Appl. No.: 833,787

[22] Filed: Apr. 9, 1997

[30] Foreign Application Priority Data

Dec. 27, 1996 [TW] Taiwan ..... 85220155 U

[51] Int. Cl.[6] ..... D05B 65/00

[52] U.S. Cl. ..... 112/292

[58] Field of Search ..... 112/292, 295, 112/298, 286, 293, 291, 296, 163, 165, 166

[56] References Cited

U.S. PATENT DOCUMENTS

| | | | |
|---|---|---|---|
| 1,401,465 | 12/1921 | DeVoe . | |
| 3,371,632 | 3/1968 | Snyder et al. . | |
| 4,455,957 | 6/1984 | Vollmar | 112/292 |
| 4,461,229 | 7/1984 | Angele et al. . | |
| 5,125,351 | 6/1992 | Prais et al. . | |
| 5,131,340 | 7/1992 | Tajima et al. | 112/292 |
| 5,481,994 | 1/1996 | Ku | 112/298 |
| 5,551,359 | 9/1996 | Ikeda et al. . | |
| 5,664,511 | 9/1997 | Tajima et al. | 112/166 X |

FOREIGN PATENT DOCUMENTS

| | | |
|---|---|---|
| 75208857 | 9/1975 | Taiwan . |
| 81107878 | 10/1981 | Taiwan . |

*Primary Examiner*—Peter Nerbun

*Attorney, Agent, or Firm*—Clifford W. Browning; Woodard, Emhardt, Naughton, Moriarty & McNett

[57] ABSTRACT

An under trimming device with inclinedly movable catchers for a multi-needle sewing machine with multiple longitudinally extended loopers comprises a cutting and clamping part, a fixed cutter, a plurality of looper assemblies and a thread push plate, characterized in that: the movable catcher of the cutting and clamping part and the looper form an angle of inclination such that when performing the thread cutting, the movable catcher extends toward the looper at an angle of inclination, and extends into the needle thread loop and the looper thread loop, and when the movable catcher returns to its initial position, the looper thread and the needle thread are cut off sequentially when they pass the fixed cutter, and the free end of the looper thread after being cut is still clamped between the leaf spring and the movable catcher, and the free ends of the cut needle threads are blown sideward in the opposite direction by an air blower to facilitate a next sewing.

2 Claims, 13 Drawing Sheets

FIG. 5
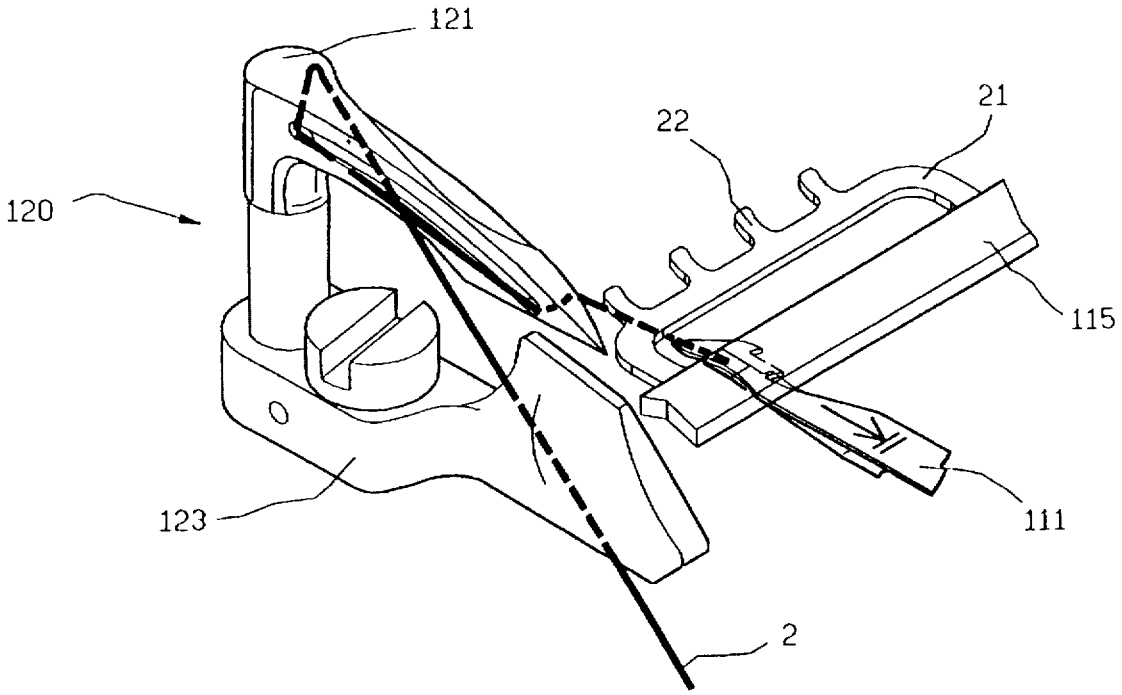
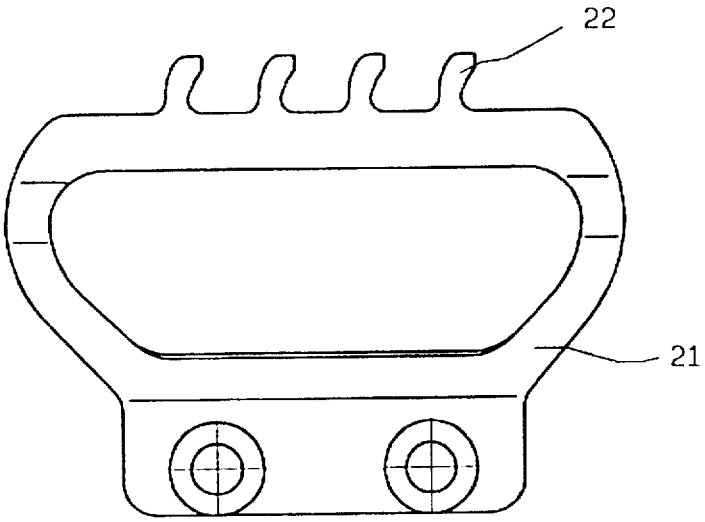
FIG. 6
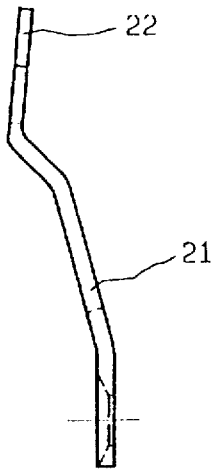
FIG. 7

UNDER TRIMMING DEVICE WITH INCLINEDLY MOVABLE CATCHERS FOR A MULTI-NEEDLE SEWING MACHINE WITH MULTIPLE LONGITUDINALLY EXTENDING LOOPERS

BACKGROUND OF THE INVENTION

1. Field of the invention

The present invention relates to an under trimming device with inclinedly movable catchers for a multi-needle sewing machine with longitudinally extended loopers, and more particularly to an under trimming device with inclinedly movable catchers for a multi-needle sewing machine with multiple longitudinally extended loopers to simultaneously cut looper threads and needle threads respectively threading through different loopers and needles and make the cut threads have free ends with the same length. The under trimming device according to the present invention may effectively present the device from coming into collision with or interfering with the needles, loopers, and other accessories of the sewing machine, permitting the sewing machine to have stable thread cutting and simplified assembling.

A multi-needle sewing machine is widely used in the sewing industry. In which, multiple needles over a needle plate of the sewing machine are used to guide multiple needle threads while corresponding multiple loopers below the needle plate are used to guide corresponding multiple looper threads. The needles and the loopers move alternately to complete the sewing, that is, the so-called chain sewing. Since the sewing principle and procedures are not the point of the present invention, they are not discussed herein.

The under trimming device of the present invention is used with a multi-needle sewing machine with multiple longitudinally extended loopers. In this type of sewing machine, a looper thereof sways back and forth in the sewing direction to guide the looper thread. The technical issue to be discussed in the present invention is: how to automatically cut the needle threads and the looper threads at the time the sewing is completed with the cut looper threads being positioned in place and having free ends of the needle threads and looper threads with the same length so as to facilitate the next sewing.

2. Description of the Prior Art

Most of the conventional multi-needle sewing machines have an under trimming device which reciprocates in parallel to the sewing direction so as to catch the needle threads and the looper threads and pull the same to a predetermined position to cut them off. For example, R.O.C. Utility Model Patent Application No. 84207505 and Patent Application No. 80108896 "screw trimming system for sewing machine" disclose a under trimming device for a multi-needle sewing machine with multiple longitudinally extended loopers, using a linked device which actuates the cutter of the under trimming device to perform the cutting and clamping of the needle threads and looper threads.

The differences between the conventional under trimming device and the under trimming device of the invention can be easily seen from FIGS. 17A–17C and FIGS. 18A–18C. As shown in FIGS. 17A–17C, two recess portions are respectively provided at two sides of the conventional movable catchers while in FIGS. 18A–18C showing the movable catchers of the invention, two recess portions are provided at the same side of the movable catcher. Further, as shown in FIGS. 17B and 18B, the conventional movable catcher and the looper are in a parallel overlapped relationship while the movable catcher and the looper of the invention form an appropriate angle of inclination.

Following disadvantages are found in the conventional under trimming device for a multi-needle sewing machine with multiple longitudinally extended loopers:

(1) Due to the limit of the mechanism, the movable catchers are placed above a thread push rod and below a needle plate; thus when a looper threads into a needle thread loop and forms a triangular loop, since the movable catcher faces the upper portion of the triangular loop such that the space becomes smaller, therefore it is necessary to precisely adjust the space; otherwise the movable catcher can not thread into the loop and thus can not perform the thread cutting. As shown in FIGS. 19 and 20; in the conventional mechanism of FIG. 19, because the width of the thread push rod 222 is smaller than that of the movable catcher above thereof, it is not easy to maintain the triangular space formed by the loop of the needle thread 3 such that the movable catcher 211 can not thread into the needle thread loop and can not perform the thread cutting, while in the mechanism of the invention in FIG. 20, the fingers of a thread push plate 22 are located above the movable catcher 111 and the width of the thread push plate is larger, which thus can ensure the loop of the needle thread 3 maintaining a relatively large triangular space such that the movable catcher can easily thread into the needle thread loop in order to complete the thread cutting.

(2) The individual thread push rod used to push the looper thread rightward is the conventional manner of expanding the loop of looper threads for individual needles. If there are a plurality of needles, it is necessary to adjust them one by one, which is time-consuming and the variation of the precision becomes large.

(3) The left and the right sides of the movable catcher are provided with a recess portion wherein the left recess portion is used for cutting the needle thread and the right recess portion is used for cutting the looper thread. The free end of the needle thread after being cut will be shorter, and thus when performing the next sewing, the thread may easily drop due to the insufficient amount of pulling out of the thread.

(4) The leaf spring is not provided with a guiding V-shaped groove and the position of the thread after being cut is not stable, and the leaf spring does not have any adjustment means, and thus it can not be adjusted when elastic fatigue happens or springiness in each position is not uniform, which will cause loose or tight clamping; or when the material of the thread is changed, such as the cotton threads being changed into flexible nylon threads, it usually happens that the threads drop or are clamped too tight.

The above described disadvantages becomes more serious in a multi-needle sewing machine with longitudinally extended loopers. It is therefore tried by the inventor to develop an under trimming device for such sewing machine to eliminate the above disadvantages.

BRIEF SUMMARY OF THE INVENTION

It is a primary object of the present invention to provide a new under trimming device with inclinedly movable catchers for a multi-needle sewing machine with longitudinally extended loopers in which multiple looper threads and needle threads are cut at the same time and the looper threads can be fixed to a predetermined place for the next sewing.

Another object of the present invention is to provide a new under trimming device with inclinedly movable catchers for a multi-needle sewing machine with longitudinally extended loopers in which the cut needle threads and looper threads have free ends in the same length, which facilitates the next sewing.

A further object of the present invention is to provide a new under trimming device with inclinedly movable catchers for a multi-needle sewing machine with longitudinally extended loopers in which the cutting and clamping part and the looper form an appropriate angle of inclination which is different from the parallel and overlapped relationship between the cutting and clamping part and looper such that when the movable catcher threads into the thread loops and return to their initial positions, it is easier to catch looper threads and cut them off and clamp them between the leaf spring and moveable catcher in order to increase the precision and stability.

The under trimming device with inclinedly movable catchers for a multi-needle sewing machine with longitudinally extended loopers according to the present invention includes a cutting and clamping part, a fixed cutter, a plurality of looper assemblies, and a thread push plate, characterized in that: the movable catcher of the cutting and clamping part and the looper of the looper assembly form an angle of inclination such that when performing the thread cutting, the movable catcher extends toward the looper at an angle of inclination, and threads into the needle thread loop and the looper thread loop. When the movable catcher moves backward to its initial position, the looper thread is clamped between the leaf spring and the movable catcher, and the looper threads and needle threads are cut off sequentially when passing the fixed cutter, and the free ends of the cut looper threads are still clamped between the leaf spring and the movable catcher.

The movable catcher extends forward at an angle of inclination in order to thread into the needle thread loop and the looper thread loop. Since the loops incline toward the side of the movable catcher provided with projected edge portions and recess portions, the movable catcher of the present invention can more easily catch the needle and looper threads than the prior art wherein the conventional movable catcher moves vertically to catch the needle thread and looper thread during the extending forward and moving backward in order to decrease the chance of error.

BRIEF DESCRIPTION OF THE DRAWINGS

The features and functions of the present invention can be best understood from the following detailed description of the preferred embodiment and the accompanying drawings, wherein:

FIG. 5 is a perspective view showing the movable catchers completing the thread cutting under the thread push plate, wherein a looper thread has been clamped between a leaf spring and a movable catcher;

FIG. 6 is a top view showing the thread push plate of the present invention;

FIG. 7 is a right side view showing the thread push plate shown in FIG. 6;

FIGS. 17A–17C are schematic views showing the successive operations of the conventional movable catcher in the thread cutting direction, wherein FIG. 17A shows the movable catcher being ready to extend forward, FIG. 17B shows the movable catcher moving into the loops formed by the needle thread and the looper thread, and FIG. 17C shows the movable catcher moves backward and the needle thread and the looper thread have been cut off;

FIGS. 18A–18C are schematic views showing the successive operations of the movable catcher of the present invention in the thread cutting direction, wherein FIG. 18A shows the movable catcher being ready to extend forward, FIG. 18B shows the movable catcher moving into the loops formed by the needle thread and the looper thread, and FIG. 18C shows that movable catcher moves backward and that the needle thread and the looper thread have been cut;

DETAILED DESCRIPTION OF THE INVENTION

Figure 1:
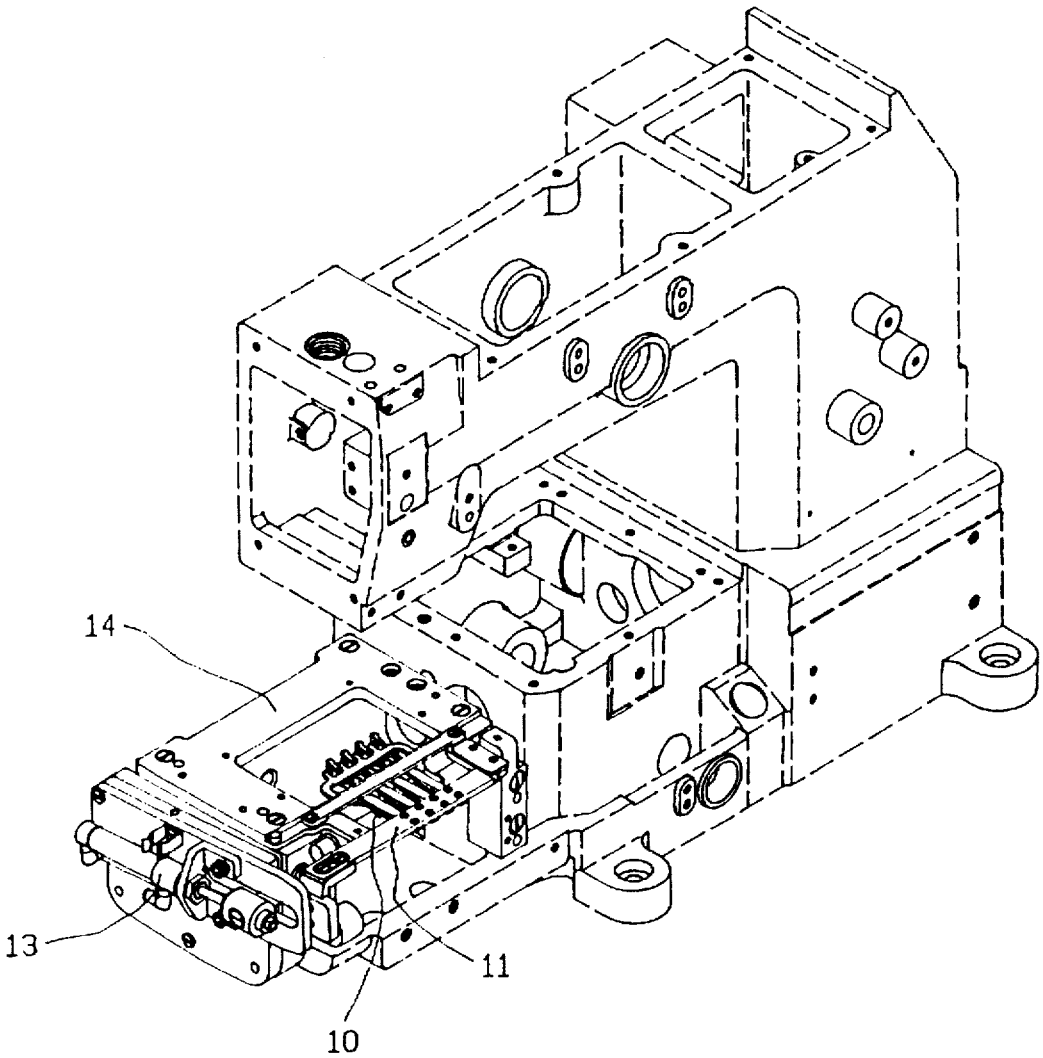
FIG. 1 is a perspective view showing the location of the under trimming device with inclinedly movable catchers of the present invention in a multi-needle sewing machine with multiple longitudinally extended loopers.

In the drawings, an embodiment of the present invention used with a four-needle sewing machine is illustrated and the details thereof will now be described hereafter.

Please refer to FIG. 1. An under trimming device 10 with inclinedly movable catchers of the present invention for a multi-needle sewing machine with multiple longitudinally extended loopers is disposed in the end portion of the bed of the sewing machine and immediately below the four needles of the sewing machine. A pneumatically or electromagnetically driven transmission mechanism 13 is disposed at the endmost portion of the machine bed to actuate a cutting and clamping part 11 of the under trimming device 10 to move reciprocatingly.

Figure 2:
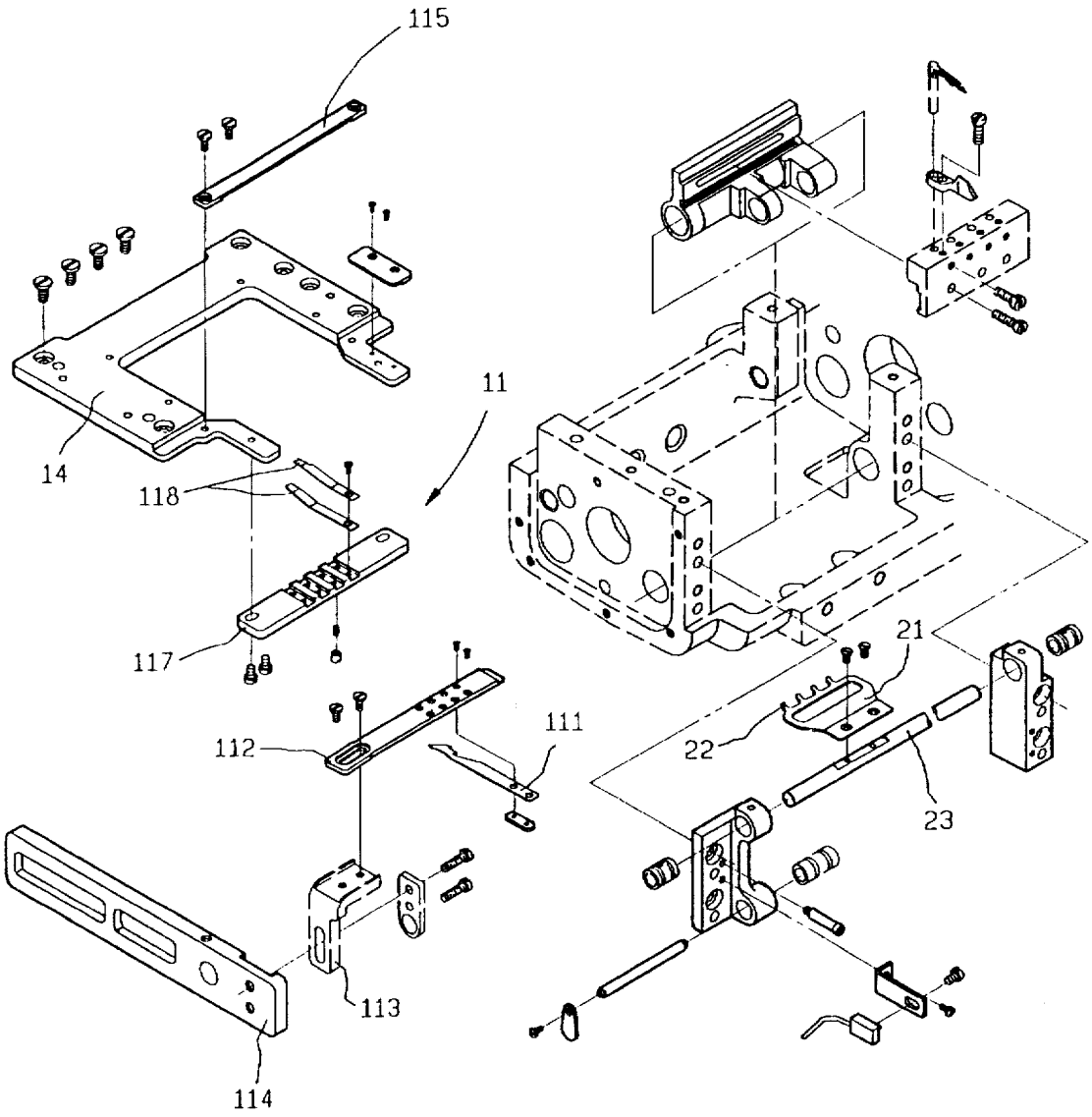
FIG. 2 is an exploded perspective view of the under trimming device for a multi-needle sewing machine with multiple longitudinally extended loopers according to the present invention.
Figure 3:
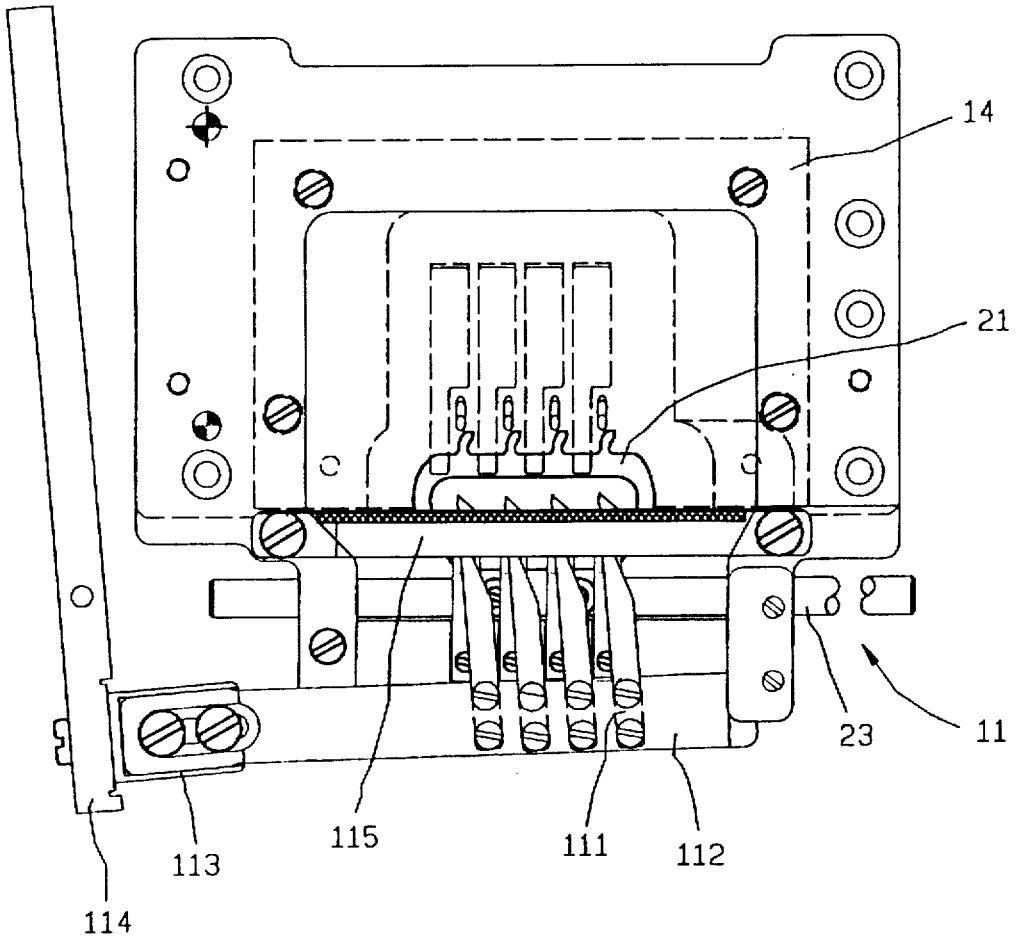
FIG. 3 is a top view showing the cutting part of the present invention wherein the movable catchers are at their initial positions.
Figure 4:
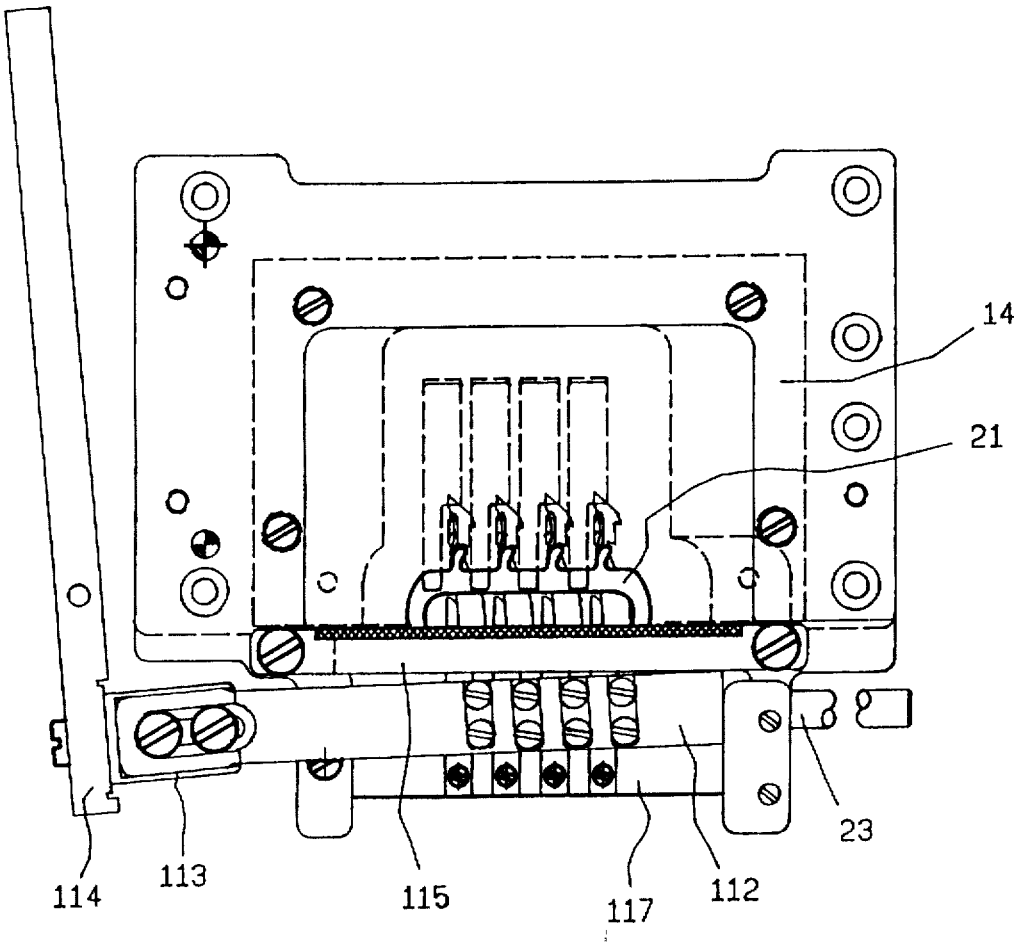
FIG. 4 is a top view showing the cutting part of the present invention wherein the movable catchers are at their extended positions.

Please refer to FIGS. 2–4, a cutting and clamping part 11 is located in front of a needle plate 14 of the sewing machine, and comprises four movable catchers 111 which are fixed to a movable-catcher holder 112 and are retained at their predetermined positions. The movable catchers 111 are connected to a link 114 via an L-shaped connecting member 113 and can be actuated by the transmission mechanism 13 to move reciprocatingly toward the loopers 121.

A fixed cutter 115 is mounted in a front end of the needle plate 14 of the sewing machine. A leaf spring mount 117 is provided at the end portion of the front end of the needle plate 14. The leaf spring mount 117 has four leaf springs 118 mounted thereon. The four leaf springs respectively press against the bottom side of the movable catchers 11 1 (please refer to FIGS. 8 and 9). The number and positions of the leaf springs 118 correspond to those of the movable catchers 111.

Figure 8:
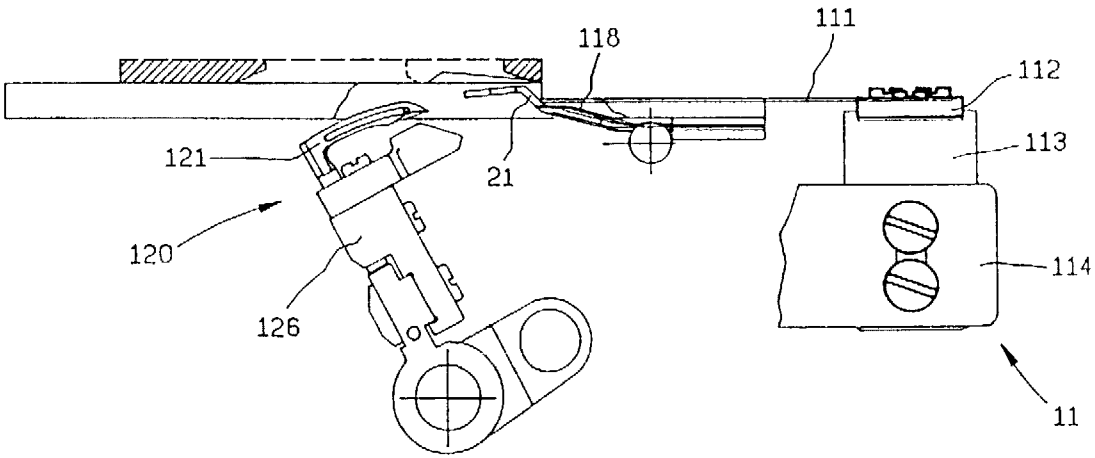
FIG. 8 is a left side view showing the position of the cutting and clamping part relative to the looper when the movable catchers are at their initial positions.
Figure 9:
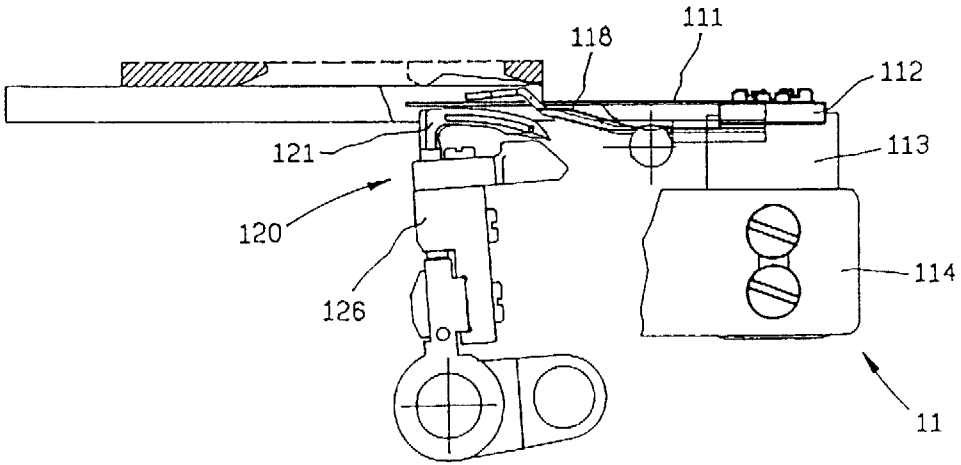
FIG. 9 is a left side view showing the position of the cutting and clamping part relative to the looper when the movable catchers are at their extended positions to a dead point thereof.

Please refer to FIGS. 5, 8 and 9. Four looper assemblies 120 each comprises a looper 121 which is mounted on a claw base 123 and the claw base 123 is fixed on a mounting block 126 and connected to a looper driving mechanism and thereby causes said assembly to longitudinally reciprocate. A looper thread 2 threads into a thread hole at the rear end of the looper 121 for sewing. The number and the positions of the looper assemblies 120 correspond to the number and positions of the movable catchers.

Please refer to FIGS. 2, 3, 4, 6 and 7, a thread push plate 21 is disposed in front of the needle plate 14. The thread push plate 21 is formed with four fingers 22 of which the number corresponds to that of the movable catchers 111, and is located above the movable catchers 111 by means of the bending of the thread push plate 21. The thread push plate 21 is fixed to a transmission shaft 23 for the thread push plate and can be actuated by the transmission mechanism of the sewing machine to reciprocate leftward and rightward in order to expand the loop formed by the looper thread 2 for facilitating the threading of the movable catchers 111.

Figure 10:
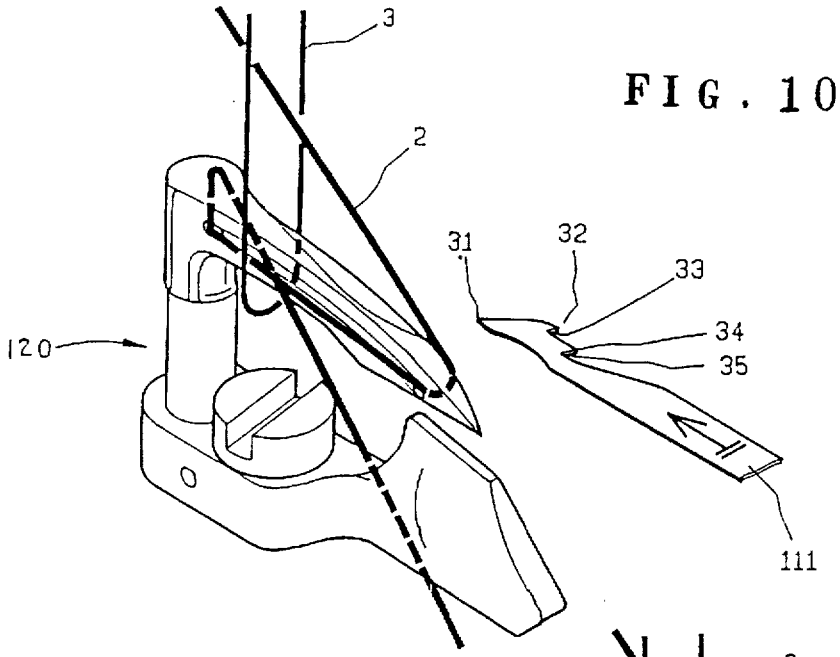
FIG. 10 is a schematic perspective view showing the movable catcher of the present invention being located before the needle thread and the looper thread.
Figure 11:
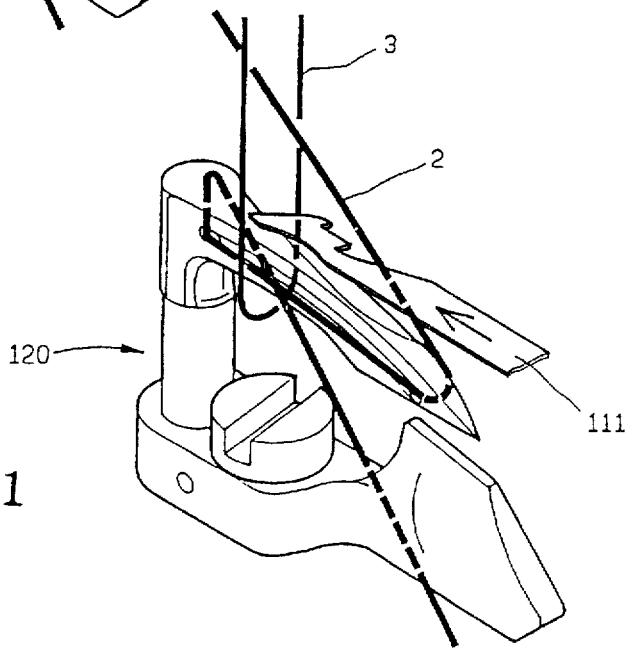
FIG. 11 is a schematic perspective view showing the movable catcher of the present invention moving to the needle thread and the looper thread.
Figure 12:
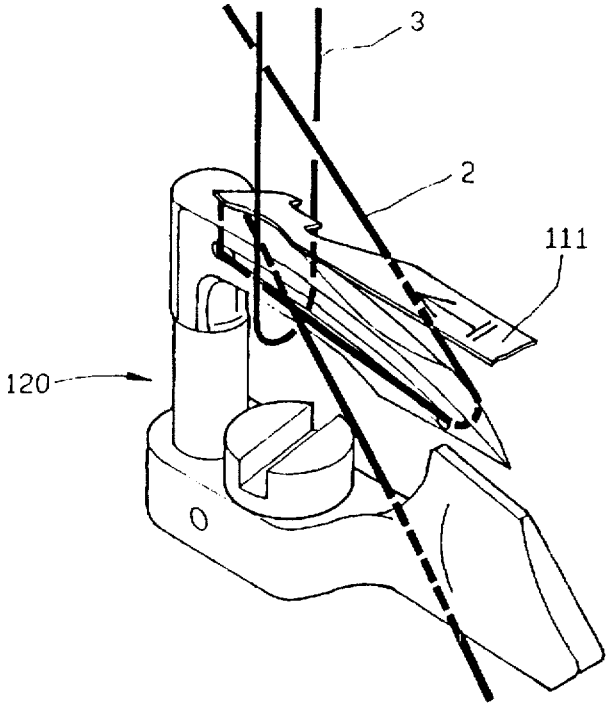
FIG. 12 is a schematic perspective view showing the movable catcher of the present invention moving into the needle thread loop and looper thread loop.

Features of the invention and a detailed description of the threading cutting are as follows:

The movable catcher 111 of the cutting and clamping part 11 and looper 121 form an angle of inclination (as shown in FIGS. 3, 4, 18A, 18B and 18C), and one side of the movable catcher 111 is provided with a first projected edge portion 32, a first recess portion 33, a second projected edge portion 34 and a second recess portion 35. Please refer to FIGS. 10–15; when performing the thread cutting, a plurality of movable catchers 111 are guided toward the loopers 121 by the transmission mechanism at an angle of inclination, and extend between the upper edge of the loopers 121 and the lower edge of the thread push plate 21 (as shown in FIG. 9). When the movable catcher 111 (FIGS. 10–12) extends toward to a dead point (not shown), the loops of the needle thread 3 and looper thread 2 are threaded through by the pointed end 31 of the movable catcher and slide respectively into the first recess portion 33 and second recess portion 35 on one side of the movable catcher 1 11 (as shown in FIG. 13).

Figure 13:
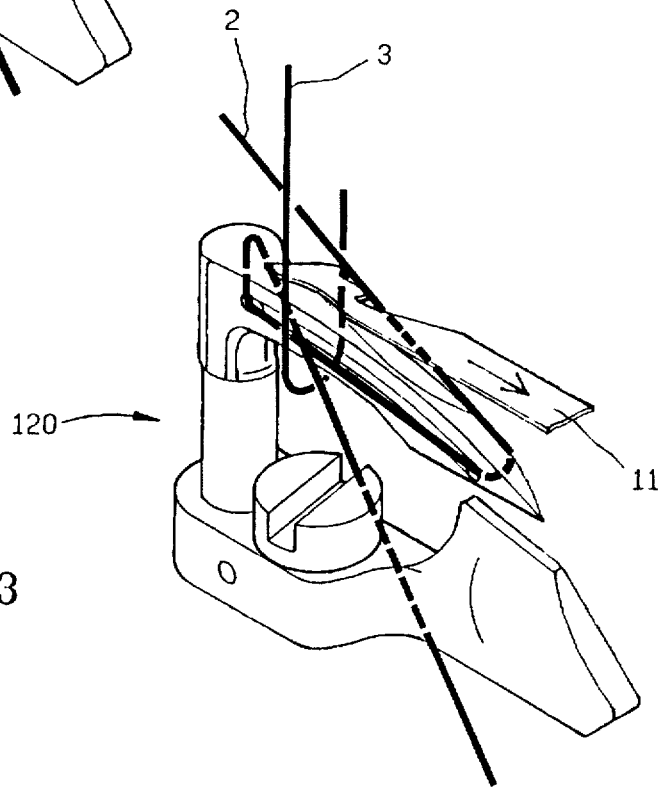
FIG. 13 is a schematic perspective view showing the movable catcher of the present invention moving into the needle thread loop and looper thread loop starts to move backward.
Figure 14:
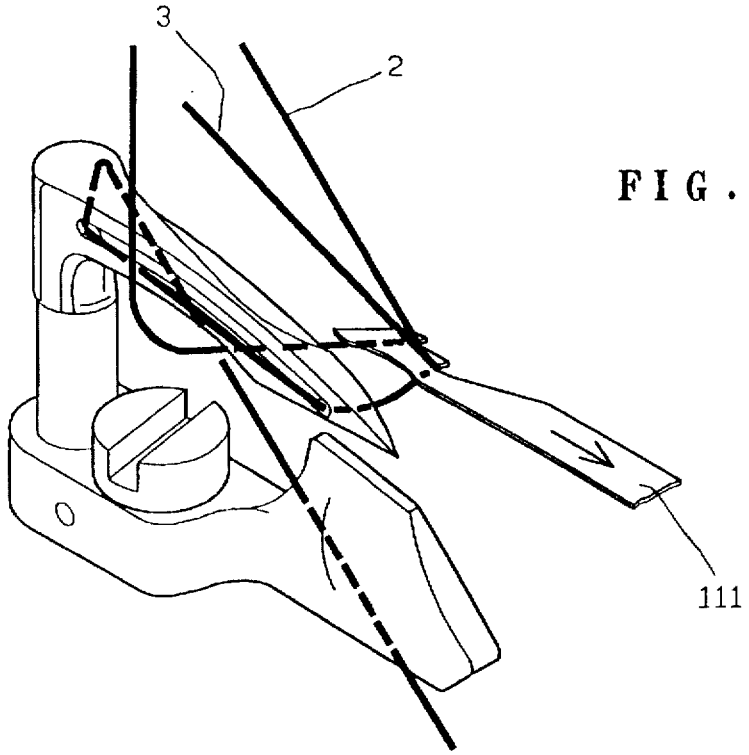
FIG. 14 is a schematic perspective view showing the movable catcher of the present invention moving into the needle thread loop and looper thread loop guiding the needle thread and looper thread to move backward.
Figure 15:
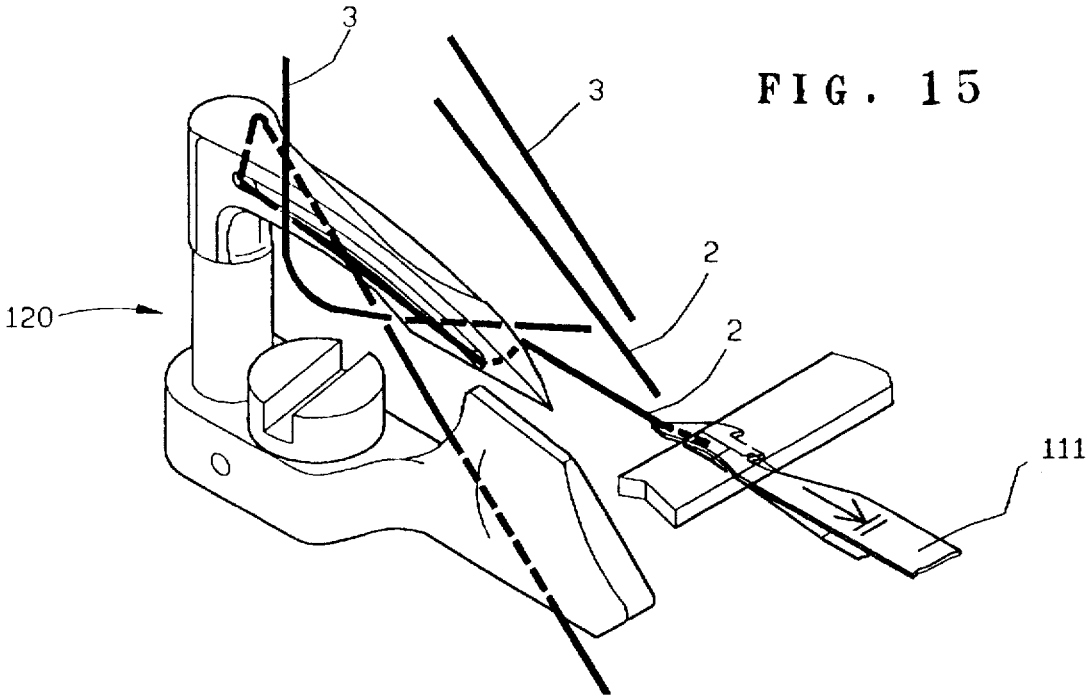
FIG. 15 is a schematic perspective view showing the movable catcher of the present invention pulling the looper thread and the needle thread toward and moving backward to its initial position so that the looper thread can be cut off and be clamped between the leaf spring and the movable catcher.

When the movable catcher 111 returns to its initial position from the dead point (as shown in FIGS. 13–15), the looper thread 2 is guided and clamped between the leaf spring 118 and movable catcher 11 1, and the looper thread 2 and the needle thread 3 are cut off sequentially when they pass the fixed cutter, and the free end of the looper thread 2 after being cut is still clamped between the leaf spring 118 and the movable catcher 111, as shown in FIG. 15.

The angle formed by the movable catcher 111 and the looper 121 is in the range of 2°–10°, preferably 6°.

The angle at which the movable catchers 111 moves inclinedly is inclined toward the side of the movable catchers 111 having projected edge portions 32, 34 and recess portions 33, 35, and thus it ensures that the movable catchers 111 can catch looper thread 2 and the needle thread 3 during their extending forward and moving backward in order to pull the looper thread and the needle thread to the fixed cutter 115 and cut them off. The inclined movement of the movable catcher can decrease the chance of error when compared with the prior art wherein the movable catchers move vertically.

Figure 16:
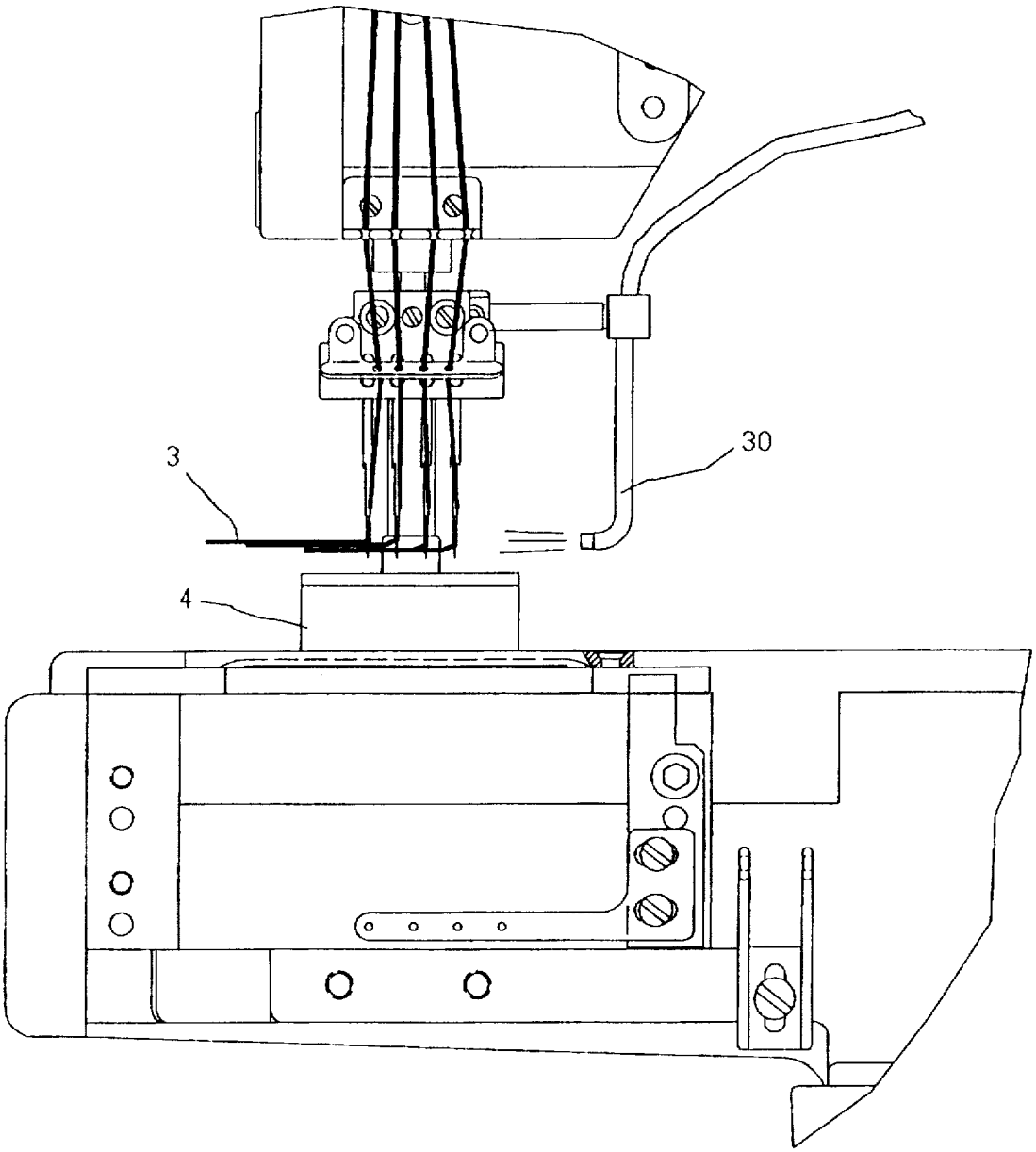
FIG. 16 is a front elevational view showing that the free ends of the cut needle threads are blown to one side by an air blower when the under trimming device of the present invention has completed its one cycle of thread trimming on the multi-needle sewing machine with longitudinally extended loopers.
Figure 17C:
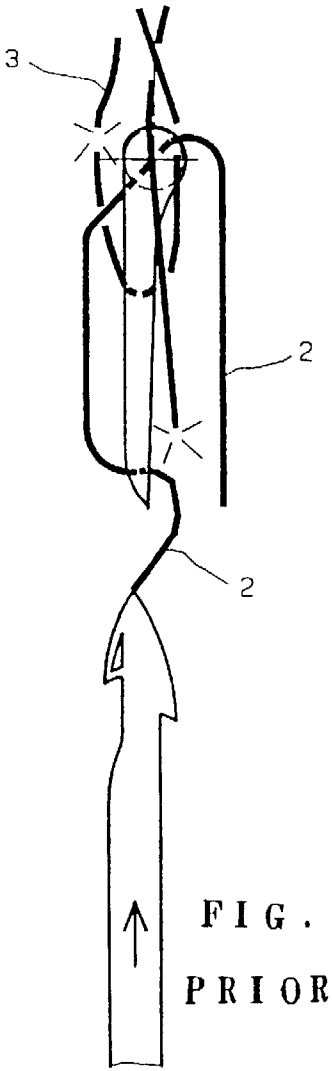
FIG. 17C PRIOR ART
Figure 17B:
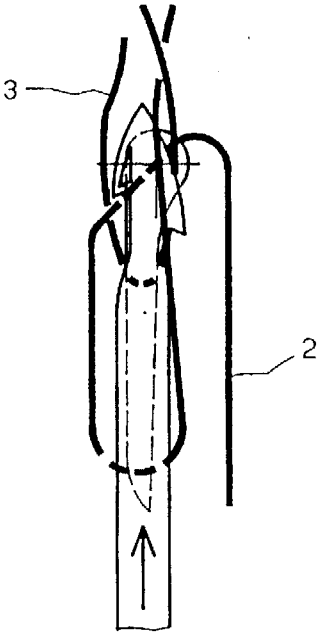
FIG. 17B PRIOR ART
Figure 17A:
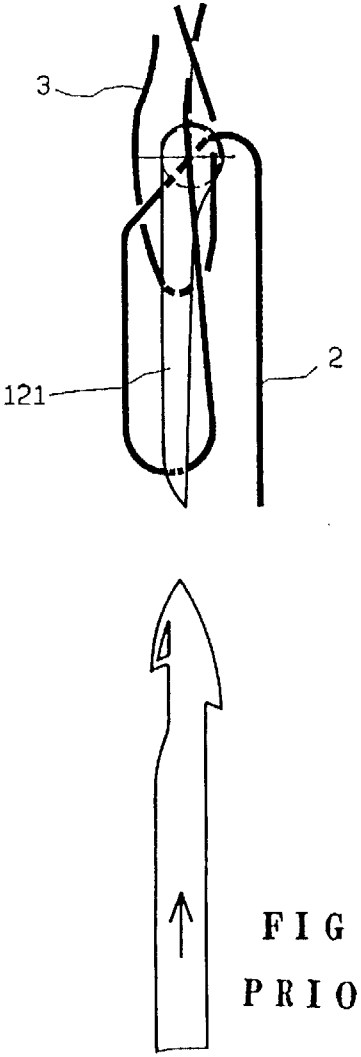
FIG. 17A PRIOR ART
Figure 18C:
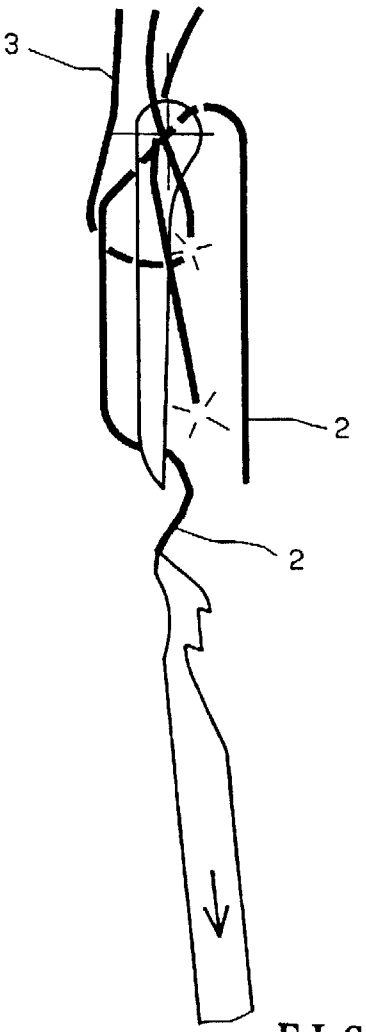
Figure 18B:
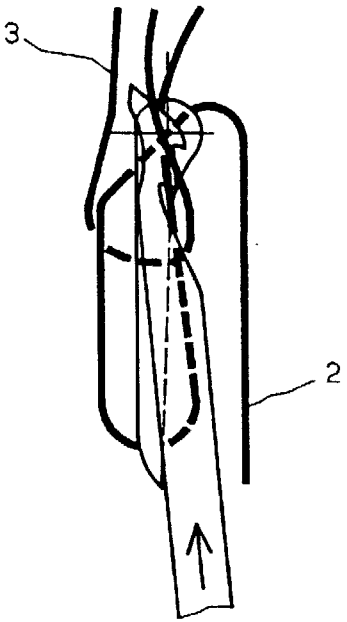
Figure 18A:
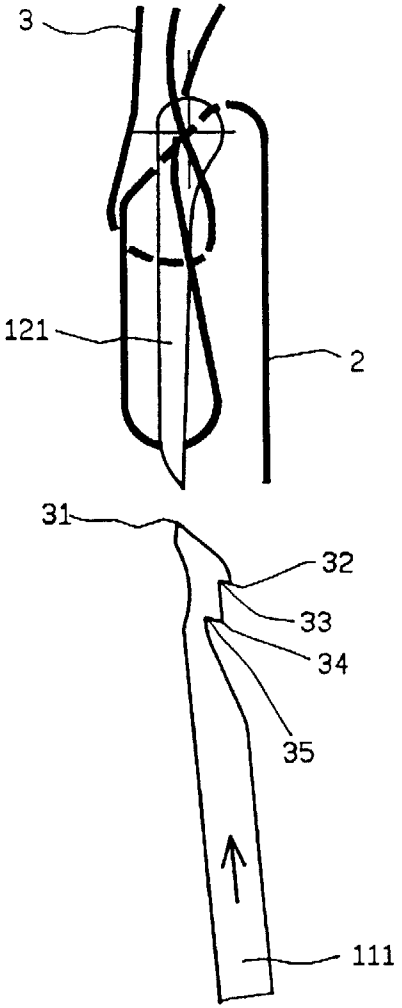
Figure 19:
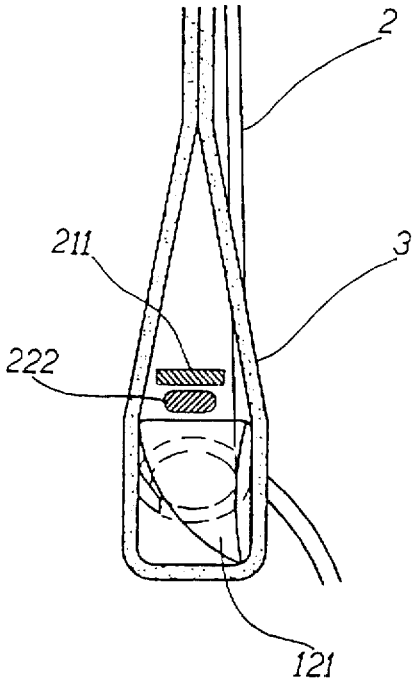
FIG. 19 PRIOR ART
FIG. 19 is a longitudinally front sectional view showing the position of the conventional movable catcher relative to the thread push rod.
Figure 20:
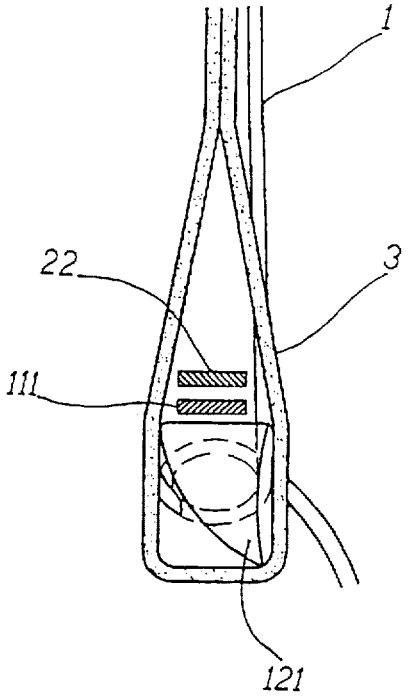
FIG. 20 is a longitudinally front sectional view showing the position of the movable catcher of the present invention relative to the thread push plate.

Please refer to FIG. 16. The present invention can also be provided with an air blower 30 mounted to one side of the needles of the sewing machine to blow the free ends of the cut needle threads 3 leftward to facilitate the next sewing.

BRIEF DESCRIPTION OF THE REFERENCE NUMERALS

| | |
|---|---|
| 2 | looper thread |
| 3 | needle thread |
| 10 | under trimming device |
| 11 | cutting and clamping part |
| 13 | transmission mechanism |
| 14 | needle plate |
| 21 | thread push plate |
| 22 | fingers |
| 23 | transmission shaft for thread push plate |
| 30 | air blower |
| 31 | pointed end of a movable catcher |
| 32 | first projected edge portion of a movable catcher |
| 33 | first recess portion of a movable catcher |
| 34 | second projected edge portion of a movable catcher |
| 35 | second recess portion of a movable catcher |
| 111 | movable catcher |
| 112 | movable-catcher holder |
| 113 | L-shaped connecting member |
| 114 | link |
| 115 | fixed cutter |
| 117 | leaf spring mount |
| 118 | leaf spring |
| 120 | looper assembly |
| 121 | looper |
| 123 | claw base |
| 211 | movable catcher |
| 222 | thread push rod |
| 126 | mounting block |

What I claim is:

1. An under trimming device with inclinedly movable catchers for a multi-needle sewing machine with multiple longitudinally extended loopers, being disposed in an end portion of a bed of said sewing machine below needles thereof, comprising:

a cutting and clamping part being disposed in front of a needle plate and including a plurality of movable catchers fixedly mounted on a movable catcher holder and retained at a predetermined position, said plurality of movable catchers being connected to a link via an L-shaped connecting member and actuated by a transmission mechanism to move reciprocatingly toward the loopers;

a fixed cutter mounted to a front end of said needle plate of the sewing machine; a leaf spring mount being provided at the end portion of said front end of said needle plate, said leaf spring mount having a plurality of leaf springs mounted thereon and said leaf springs respectively pressing against the bottom sides of said movable catchers; the number and positions of said leaf springs correspond to those of said movable catchers;

a plurality of looper assemblies each comprising a looper which is mounted on a claw base, said claw base being fixed on a mounting block and connected to a looper driving mechanism of said sewing machine in order to longitudinally reciprocate, a looper thread threading into a thread hole provided at the rear end of the looper for sewing, and the number and the positions of the looper assemblies corresponding to the number and positions of said movable catchers; and a thread push plate being provided below said needle plate and having a plurality of fingers of which the number corresponds to that of said movable catchers, said thread push plate being fixed to a transmission shaft for said thread push plate and actuated by said transmission mechanism of said sewing machine to reciprocate rightward and leftward in order to expand the loop formed by said looper threads for facilitating the extending of said movable catchers into said loops; characterized in that:

said movable catcher of each said cutting and clamping part and each said looper form an angle of inclination, and one side of each said movable catcher is provided with a first projected edge portion, a first recess portion, a second projected edge portion and a second recess portion such that when performing the thread cutting, a plurality of movable catchers are actuated and moved toward the loopers by said transmission mechanism at an angle of inclination, and extend between the upper edges of said loopers and each said lower edge of said thread push plate; and when a movable catcher extends toward to a dead point, the loops of a needle thread and looper thread are threaded through by a pointed end of each said movable catcher and slide respectively into said first recess portion and second recess portion on one side of said movable catcher; and when each said movable catcher returns to its initial position from the dead point, said looper thread and said needle thread are cut off sequentially when they pass said fixed cutter, and the free end of said looper thread after being cut is still clamped between each said leaf spring and each said movable catcher.

2. An under trimming device with inclinedly movable catchers for a multi-needle sewing machine with multiple longitudinally extended loopers as claimed in claim 1, further comprises an air blower disposed to one side of a plurality of needles of said sewing machine for blowing said free ends of said cut needle threads sideward in the opposite direction to facilitate a next sewing.

* * * * *

UNITED STATES PATENT AND TRADEMARK OFFICE

CERTIFICATE OF CORRECTION

PATENT NO : 5,775,246

DATED : July 7, 1998

INVENTOR(S) : Yu Wen LIN

It is certified that error appears in the above-identified patent and that said Letters Patent is hereby corrected as shown below:

In column 1, line 19, please delete the word "present" and insert in lieu thereof --prevent--

In column 4, line 59, please insert the word --the-- between the words "that movable"

Signed and Sealed this

Twenty-sixth Day of January, 1999

*Attest:*

*Attesting Officer*

*Acting Commissioner of Patents and Trademarks*